United States Patent [19]

Clayton

[11] 4,334,564

[45] Jun. 15, 1982

[54] GOLF CLUB BAG

[76] Inventor: Charles R. Clayton, 606 Coolidge, Midvale, Utah 84070

[21] Appl. No.: 194,618

[22] Filed: Oct. 6, 1980

[51] Int. Cl.[3] ..... A63B 55/02

[52] U.S. Cl. ..... 150/1.5 C

[58] Field of Search ..... 150/1.5 R, 1.5 C, 1.5 B

[56] References Cited

U.S. PATENT DOCUMENTS

| | | | |
|---|---|---|---|
| 2,010,166 | 8/1935 | Thompson | 150/1.5 R |
| 2,047,079 | 7/1936 | MacMurray | 150/1.5 R |
| 2,546,416 | 3/1951 | Alter et al. | 150/1.5 R |
| 2,925,840 | 2/1960 | Hird | 150/1.5 R |
| 3,554,255 | 1/1971 | Mangan | 150/1.5 R |

*Primary Examiner*—Donald F. Norton

*Attorney, Agent, or Firm*—Thorpe, North & Western

[57] ABSTRACT

A golf club bag is formed of a plurality of elongate receptacles attached together in a row and parallel to one another to lie generally flat on a support surface. Each receptacle is dimensioned to receive the handle of a golf club. The receptacles are made of a resilient material which will allow folding the receptacles over one another into a bundle as well as laying the receptacles out generally flat. A handle is attached to the receptacles centrally thereof for holding the bag. If desired, another row of receptacles can be formed and attached back-to-back to the first receptacles thereby increasing the number of golf clubs which can be carried.

8 Claims, 4 Drawing Figures

GOLF CLUB BAG

BACKGROUND OF THE INVENTION

This invention relates to a flexible, foldable golf club bag.

Conventional golf club bags are typically formed into fairly rigid receptacles having circular or oblong cross-sections into which all of the golf clubs to be carried are placed. In some configurations, plastic cylindrical tubes are positioned in the bag, each of which is for receiving a different one of the golf clubs.

With the above designs, the size and shape of the bag is fairly rigidly fixed so that a predetermined volume of space is required to store or transport the bag. This limits storage flexibility when traveling or moving about and can cause inconvenience when inadequate space is available for accommodating the bags.

SUMMARY OF THE INVENTION

It is an object of the invention to provide a new and useful golf club bag which may be folded or configured to fit in a variety of spaces.

It is another object of the invention to provide such a golf club bag which is easy and inexpensive to construct.

It is a further object of the invention to provide a golf club bag which may be configured to have either a generally flat profile or a generally "bundled" profile.

The above and other objects of the invention are realized in a specific illustrative embodiment thereof which includes an array of generally elongate receptacles flexibly joined together in a row. Each receptacle is dimensioned so that it may receive the handle of a golf club and each is generally parallel with the other receptacles. Also included is a handle coupled to the receptacles to allow for carrying the bag. The receptacles are flexibly joined so that they may be folded, rolled up, laid generally flat, or placed in a variety of different configurations depending upon the space into which they are fitted.

In accordance with one aspect of the invention, a second array of generally elongate receptacles are flexibly joined together and are attached to the first array, centrally thereof. When the first array is folded into a circle, they generally circumscribe the second array, which is fewer in number.

In accordance with another aspect of the invention, a golf ball enclosure is positioned centrally off the second array of receptacles so that when the first array is folded into a circle, the golf ball enclosure and the second array of receptacles are generally circumscribed by the first array.

The above-described configuration offers considerable flexibility in storing and transporting the golf bag since it can be folded, laid flat, or oriented in a variety of other positions to fit into available storage or carrying space.

BRIEF DESCRIPTION OF THE DRAWINGS

The above and other objects, features and advantages of the present invention will become apparent from a consideration of the following detailed description presented in connection with the accompanying drawings in which.

DETAILED DESCRIPTION

Figure 1:
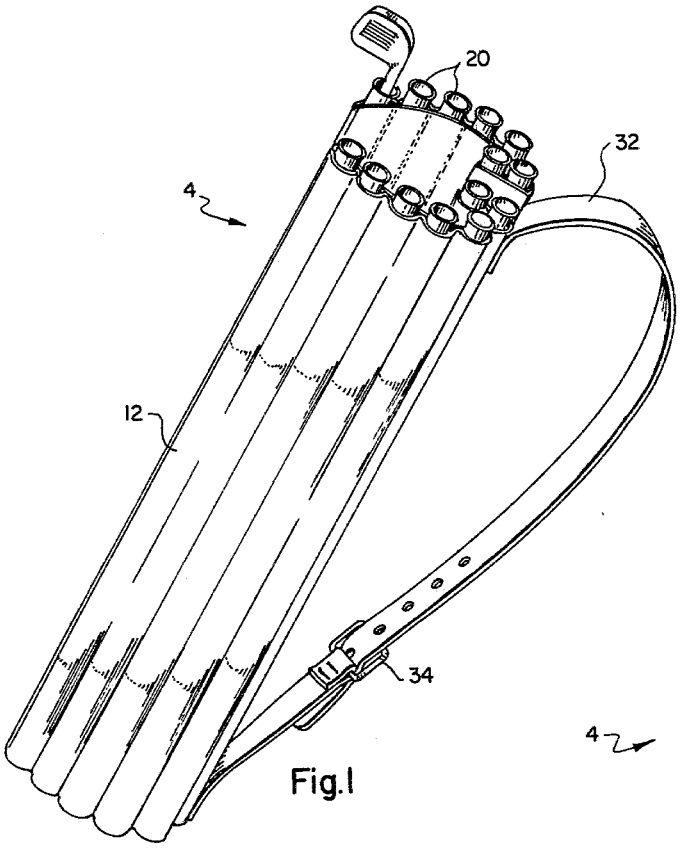
FIG. 1 is a perspective view of a golf club bag made in accordance with the principles of the present invention.

Referring to the drawings, there is shown a golf club bag generally indicated by the numeral 4. The bag includes a first piece of flexible material 8 (best seen in FIG. 4) joined to a second piece of flexible material 12 which is formed with generally elongate folds as shown. The first and second pieces of material 8 and 12 are joined together by stitching 16 or other suitable attachment mechanism, with the stitching extending lengthwise on other side of a fold, to form elongate receptacles in a side-by-side array.

Advantageously, inserted within each fold is a hollow, cylindrical tube 20 made of plastic or other suitable material similar to those presently used for holding golf clubs in conventional golf club bags. The tubes 20 extend substantially the full length of the receptacles and maintain openings into which golf club handles may be inserted. The interior dimensions of the tubes 20, of course, are such that a conventional golf club handle may be inserted thereinto. The tubes 20 need not be used if a person preferred to simply insert the golf clubs directly into the openings formed by the folds.

Figure 2:
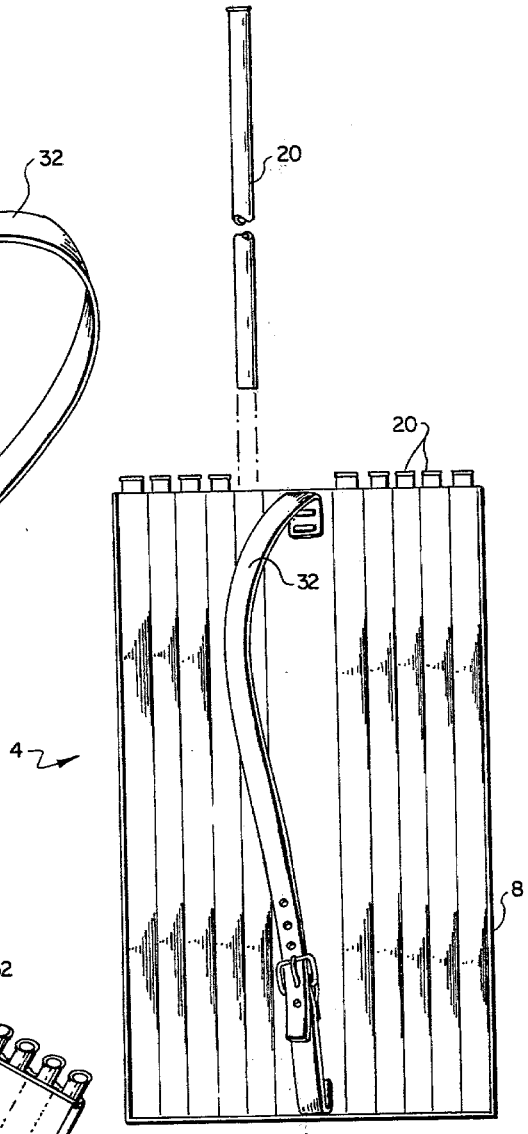
FIG. 2 is a back, elevational view of the golf club bag of FIG. 1 showing one of the plastic golf club holding tubes removed and fragmented.
Figure 3:
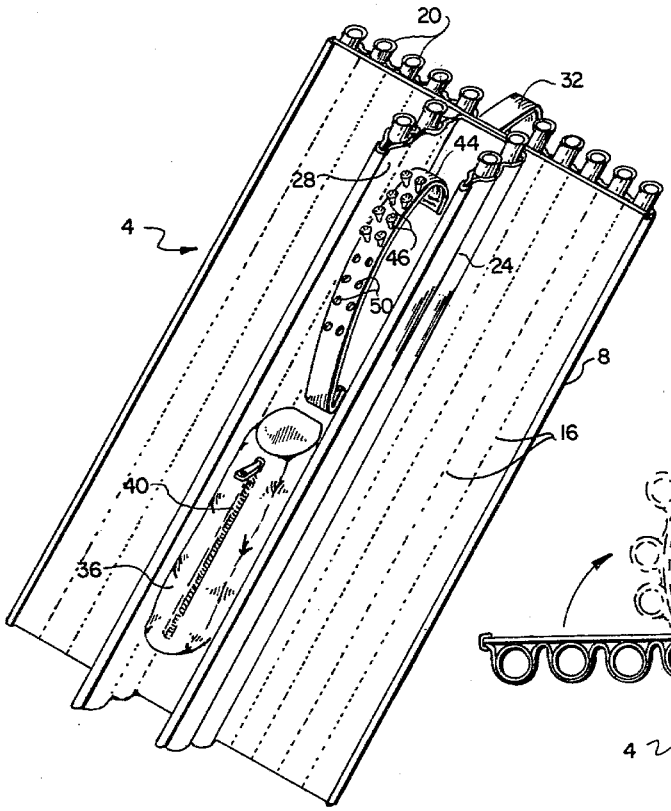
FIG. 3 shows a generally front, perspective view of the gold club bag of FIG. 1 where the primary golf club holding receptacles are arranged in a substantially linear row.
Figure 4:
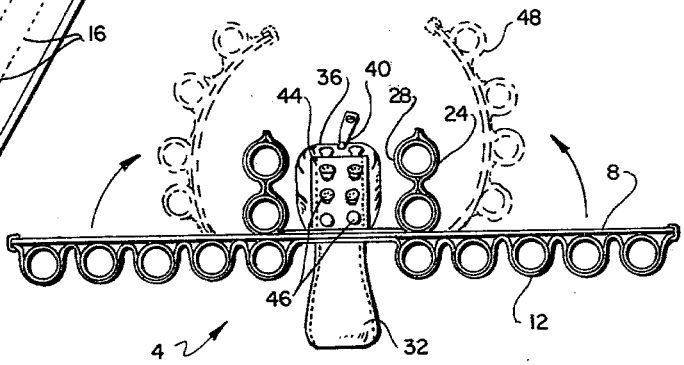
FIG. 4 is a top plan view of the golf club bag as it is configured in FIG. 3, but also showing in dotted line how the primary row of receptacles may be folded about the secondary receptacles.

The material 8 and 12 may be made of heavy cloth, synthetic material or other suitable flexible material to allow folding or configuring the receptacles in either a "bundled" position as in FIG. 1 or a generally flat position as in FIGS. 2, 3 and 4. This facilitates placement of the receptacles in a variety of storage or carrying spaces.

A second array of receptacles is formed of two pieces of material 24 and 28, being joined together by stitching or other suitable attachment mechanism in a manner similar to that described for the first array. The second array is attached back-to-back to the first array as best seen in FIG. 4. The first array is shown as having a total of 10 receptacles, whereas the second array has only four. Advantageously, a hollow, cylindrical plastic tube is inserted in each one of the receptacles of the second array, again for maintaining an opening into which a golf club handle could be inserted.

Located centrally of the first array of receptacles is a strap 32, one end of which is attached to the material 12 near the top thereof and the other end of which is attached to the material 12 near the bottom to form a loop as shown. The strap 32 serves as a handle for carrying the golf bag in the conventional manner. The strap 32 includes a conventional buckle 34 to enable shortening or lengthening the loop formed by the strap. The strap 32 may be constructed of any suitably sturdy and long-lasting material such as leather, imitation leather, sturdy cloth, etc.

Disposed centrally of the second array of receptacles is a pouch or enclosure 36 into which golf balls, golf keys, and other playing equipment may be paced. An opening is formed in the front of the enclosure with a zipper 40 attached thereto for allowing closure of the opening. The enclosure 36 is generally elongate so that it fits neatly between two of the receptacles on one side and two on the other side of the second array. Enclosure 36 is attached to material 28 which is used to partly form the second array of receptacles.

A golf tee-holding strap 44 is attached also to the material 28 above the enclosure 36 to carry tees 46 at a readily accessible location. Openings 50 are formed in the strap 44 so that the pointed ends of the tees may be inserted thereinto as shown.

With the golf bag structure described, a bag may be oriented to be generally flat or it may be folded to be generally "bundled". The folding is shown by dotted line 48 in FIG. 4.

It is to be understood that the specific embodiment discussed above is only illustrative of the principles of the present invention and that numerous other embodiments and configurations could be made by those skilled in the art without departing from the spirit and scope of the invention. For example, any number of receptacles may be added to or subtracted from the two arrays shown. Likewise, only one array need be provided, depending upon the desires of the user. Additionally, the receptacles for receiving the golf club handles could be formed in a variety of ways besides that shown in the drawings and described above.

What is claimed is:

1. A golf bag comprising:

a plurality of generally elongate receptacles, each of a dimension sufficient to receive the handle of a golf club, means flexibly joining the receptacles together in a first side-by-side array and generally in a row, an additional plurality of generally elongate receptacles, fewer in number than the first-mentioned plurality or receptacles, each of a dimension sufficient to receive the handle of a golf club, means flexibly joining the additional receptacles together in a second generally side-by-side array and generally in a row, means connecting the second array of receptacles at a central location thereof and in common orientation with the first array of receptacles and at a central location thereof in a generally back-to-back relationship so that the first array of receptacles may substantially encircle the second array, and handle means coupled centrally to said first array of receptacles or flexible joining means to enable holding the two arrays of receptacles.

2. A golf bag as in claim 1 wherein the first array of receptacles is formed from two pieces of flexible material, a first of which is generally planar and a second of which is formed with generally elongate folds and joined to the first material on each side of a fold.

3. A golf bag as in claim 2 further including a plurality of hollow, elongate and generally rigid conduits, each insertable within a fold formed by the second material and each material to receive the handle of a golf club.

4. A golf bag as in claim 1 wherein said handle means is disposed centrally of said first array of receptacles so that an equal number of receptacles are positioned on each side of the handle means.

5. A golf bag as in claim 4 wherein said handle means is disposed on one side of said first array of receptacles, and wherein said second array of receptacles is connected to said first array of receptacles on the other side thereof.

6. A golf bag as in claim 1 further including an enclosure formed with an opening therein through which golf balls are received into the enclosure and disposed centrally of said second array of receptacles to form a structure around which the first and second arrays of receptacles may bundle when being carried by the handle means.

7. A golf bag as in claim 6 further including means for closing the opening of said enclosure.

8. A golf bag as in claim 1 further including tee carrying strap means disposed centrally of said second array of receptacles, around which the first and second arrays of receptacles may bundle, and including a plurality of openings for receiving the pointed ends of golf tees.

* * * * *

UNITED STATES PATENT AND TRADEMARK OFFICE

CERTIFICATE OF CORRECTION

PATENT NO. 4,334,564

DATED June 15, 1982

INVENTOR(S) Charles R. Clayton

It is certified that error appears in the above-identified patent and that said Letters Patent are hereby corrected as shown below:

Claim 1, line 39, change "or" to --of--.

Signed and Sealed this

*Tenth* Day of *August 1982*

[SEAL]

*Attest:*

GERALD J. MOSSINGHOFF

*Attesting Officer*

*Commissioner of Patents and Trademarks*